United States Patent [19]

Zeigler, Jr. et al.

[11] Patent Number: 4,686,952

[45] Date of Patent: Aug. 18, 1987

[54] CONTROLLED PCV VALVE

[75] Inventors: Thornton W. Zeigler, Jr., Huntsville; Chris S. Romanczuk, Madison; Joseph T. Betterton, Arab; Alfred H. Glover, Decatur, all of Ala.

[73] Assignee: Chrysler Motors Corporation, Highland Park, Mich.

[21] Appl. No.: 944,312

[22] Filed: Dec. 22, 1986

[51] Int. Cl.[4] ..... F02B 25/06

[52] U.S. Cl. ..... 123/572; 123/574; 137/501

[58] Field of Search ..... 123/572, 574, 41.86, 123/198 P; 137/501, DIG. 8

[56] References Cited

U.S. PATENT DOCUMENTS

| | | | |
|---|---|---|---|
| 3,175,546 | 3/1965 | Roper | 123/572 |
| 3,589,347 | 6/1971 | Sawada | 123/572 |
| 3,678,910 | 7/1972 | Marlett | 123/574 |

*Primary Examiner*—Craig R. Feinberg
*Assistant Examiner*—Marguerite Macy
*Attorney, Agent, or Firm*—Kenneth H. MacLean, Jr.

[57] ABSTRACT

A positive crankcase ventilation control for an internal combustion engine having a selectively operated bypass to a conventional pressure responsive flow control.

7 Claims, 5 Drawing Figures

CONTROLLED PCV VALVE

BACKGROUND OF THE INVENTION

For a considerable period of time, the vaporous emissions from the crankcase of internal combustion engines have been routed to the carburetor or air inlet of the internal combustion engine for disposal. Thus, this system prevents these vapors from being emitted to the atmosphere untreated. While such a system is beneficial to the environment, during certain periods of operation of the internal combustion engine and the associated vehicle, the routing of large quantities of vapor from the crankcase is detrimental to engine performance. Therefore, these systems have utilized a valving mechanism to control the routing of crankcase vapors to the intaking system of the engine. These systems utilize a PCV device or positive crankcase ventilation valve to control the flow of emissions from the crankcase to the inletting of the engine.

The PCV device or valve controls air flow to the engine air fuel inlet so as to restrict circulation of crankcase vapors, particularly during idle and to open the system more fully for flow of crankcase emissions during high speed operation. The PCV valve functions generally in accord with the pressure differential between the crankcase or the valve chamber of the engine and the intake manifold of the engine. During low engine speeds, it is desirable to reduce the flow from the crankcase to the intake manifold. It is also desirable to reduce air flow during certain transient conditions, such as acceleration. This prevents excessive leaning of the combustion mixture which could result in stalling or stumbling of the engine.

The typical PCV valve includes a housing with an inlet and an outlet and a flow chamber therebetween including a flow control passage just upstream of the outlet. An elongated plug-like valve is movable in the flow chamber and has one end which normally is seated against a valve at the inlet to greatly decrease entry of vapors to the device. A light spring normally holds the plug valve in the position against the valve seat. The other end of the plug valve is configured with a taper so that as the plug valve moves against the spring, this end progressively fills the flow control passage to regulate the flow of vapors from the crankcase to the intake manifold. During idle conditions, when the vacuum pressure is at a maximum in the intake manifold, the plug valve is moved against the spring so that the tapered end thereof substantially occupies a large area of the flow control passage thereby restricting passage of emissions to the intake manifold.

During normal mid-range speed of the internal combustion engine, substantially greater crankcase emission flow is tolerated by the engine than at idle or low speed. Consequently, PCV valves are designed to provide a substantially greater flow of crankcase emissions to the intake manifold of the engine under these conditions.

SUMMARY OF THE INVENTION

The aforedescribed PCV valve or device has been utilized for many years. It has been found that it would be very desirable to have a PCV valve or device which operates like the aforedescribed previously known PCV valve, but which selectively has much greater flow capacity under certain operative conditions of the internal combustion engine. In addition, the capacity for controlling various engine devices and components by electronic means associated with modern internal combustion engines has permitted great flexibility in providing optimum operating conditions of the engine and optimum functioning of various components such as crankcase emission valve. Therefore, it is an object of this invention to provide a selectively controlled PCV valve or device which has greatly increased flow capacity therethrough when remotely or selectively controlled while, at the same time, functions in the manner of the previously known PCV valve when uncontrolled by the selective engine control means.

The subject invention provides a PCV valve of a configuration similar to the PCV valve previously used, but further including a normally closed bypass passage to the flow control passage of the PCV valve. This bypass passage is normally blocked by valve means which is selectively moved to an open position permitting very substantial increases in flow through the device via the bypass passage. Because many engine components are operated by vacuum actuators or motors, the subject invention utilizes a vacuum pressure driven diaphragm motor to control the bypass valve member. The routing of vacuum to the vacuum actuator or motor, of course, could be, in turn, controlled by any kind of control, for instance, by means of an electronically initiated control.

Further advantageous features and objects of the subject selectively controlled PCV valve or device will be more readily understood and appreciated by a reading of the following detailed description of a preferred embodiment, reference being had to the drawings in which the preferred embodiment is illustrated.

IN THE DRAWINGS

DETAILED DESCRIPTION OF A PREFERRED EMBODIMENT

Figure 1:
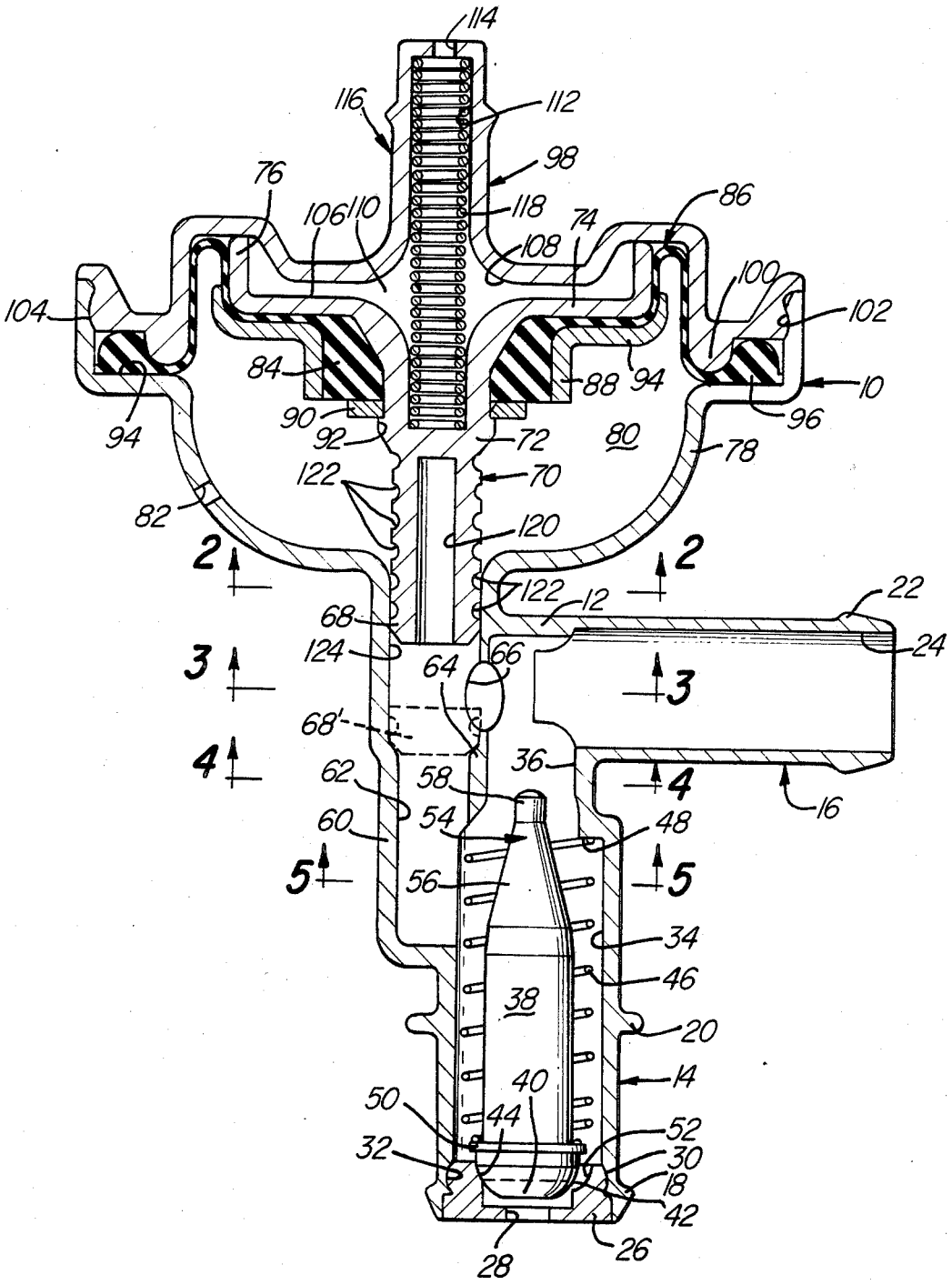
FIG. 1 is an elevational and sectioned view of the subject device showing the normal plug valve in a normal rest position.
Figure 2:
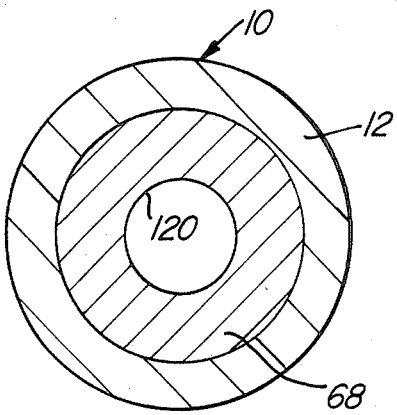
FIG. 2 is an enlarged sectioned view taken along section line 2—2 in FIG. 1 and looking in the direction of the arrows.
Figure 3:
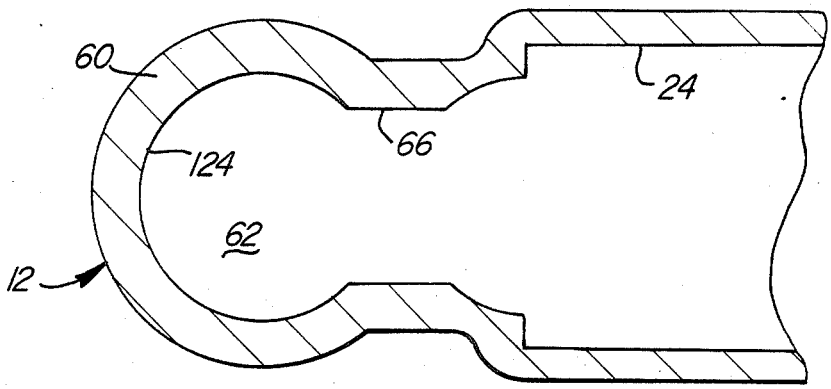
FIG. 3 is an enlarged sectioned view taken along section line 3—3 in FIG. 1 and looking in the direction of the arrows.
Figure 4:
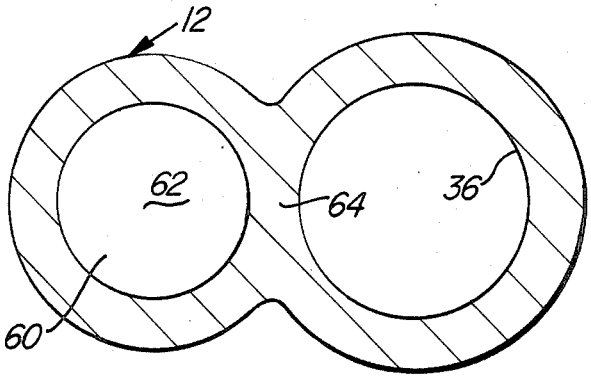
FIG. 4 is an enlarged sectioned view taken along section line 4—4 in FIG. 1 and looking in the direction of the arrows.
Figure 5:
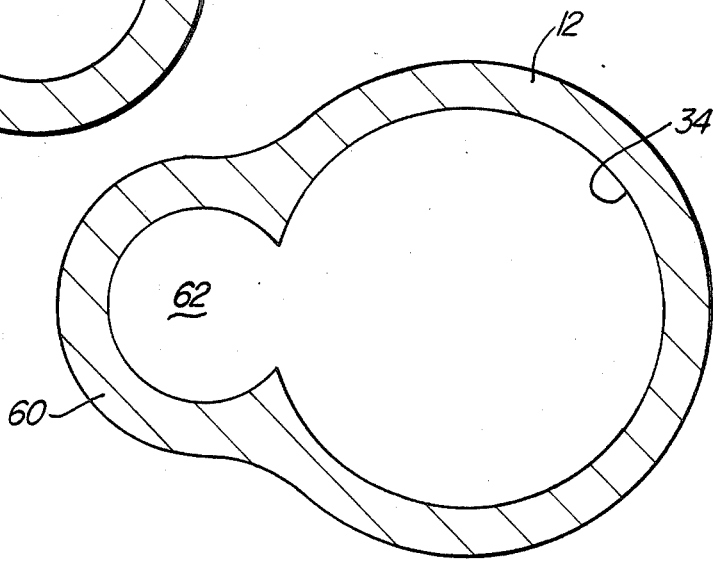
FIG. 5 is an enlarged sectioned view taken along section line 5—5 in FIG. 1 and looking in the direction of the arrows.

In FIG. 1, the subject selectively controlled PCV device 10 is illustrated. The device or valve 10 includes a housing 12 of either cast metal or sufficiently rigid plastic material to form a substantial structure. The housing 12 includes a lower crankcase vapor emission inlet portion 14 and a vapor outlet portion 16. The inlet portion 14 has a tubular configuration with an outwardly extending lip formation thereon which is adapted to be snugly inserted within the aperture of an elastomeric support grommet (not shown) of the associated internal combustion engine. The elastomeric grommet is typically held within an opening to the engine valve cover. The engine valve cover defines an interior space with the engine cylinder head which is fluidly connected to the engine crankcase. Axially upward from the lip formation 18 is a second lip formation 20 which is for the purpose of limiting insertion of the inlet portion 14 into the engine supported elastomeric grommet.

The outlet means 16 also has a lip 22 formed thereabout near the end to receive and sealingly engage the inner diameter surface portion of an elastomeric hose (not shown). The hose is adapted to slip about the outlet portion 16 to connect with an interior outlet passage 24 of housing 12. The hose extends from the device 10 to an inlet fitting of the engine air and fuel system as the air cleaner of the engine.

The inlet portion 14 of housing 12 supports an inlet orifice forming member 26 defining a central aperture 28 therethrough. The aperture 28 in member 26 permits a controlled flow of crankcase emissions (primarily air) into the interior of housing 12. The member 26 has an arcuate circumferential surface 30 adapted to be snugly engaged by a similarly configured surface 32 on the inlet portion 14 to secure member 26 to the inlet portion 14. An enlarged diameter valved chamber 34 is formed within housing 12 and partially within the inlet portion 14 downstream from the aperture 28 for the flow of crankcase emissions and air to the outlet passage 24. A somewhat reduced diameter flow control passage 36 is formed downstream from the enlarged chamber 34 and just upstream from the outlet passage 24. An elongated plug valve 38 is located in the enlarged chamber 34 and includes a lower end portion 40 with an annular surface 42 thereon. A similarly configured surface 44 is formed in the orifice forming member 26 to support the plug valve 38 in the rest position shown in FIG. 1. A light spring 46 extends between a spring support shoulder 48 of housing 12 and an outwardly extending ring portion 50 of the plug valve 38. The spring 46 normally maintains the plug valve 38 in the rest position shown in FIG. 1 with surfaces 42 and 44 engaging one another. Flow into the chamber 34 from the aperture 28 is maintained in bypass relationship to the plug valve 38 by means of a plurality of channels or grooves 52 formed in the member 26.

Plug valve 38 has an upper end portion 54 which is configured with a tapered formation defining a converging conical surface 56 thereon. The extreme end portion 58 is in the form of a relatively small diameter cylindrical configuration relative to the cylindrical portion of the main body of plug valve 38. In normal operation of the PCV device 10 in association with the internal combustion engine, the plug valve 38 moves upward against the urging of spring 46 in response to a pressure differential between the fluid at aperture 28 or internal to the engine and the pressure of the intake manifold as transmitted by the aforedescribed hose to the inlet passage 28 of the device 10. This pressure differential lifts the valve or moves it upward to cause the conical surface 56 to progressively move further into the flow control passage 36, thereby occupying increasingly greater flow space of the passage. Thus, as the intake manifold vacuum increases, the plug valve 38 is moved further upward from the rest position shown in FIG. 1 so as to progressively decrease the flow area through the passage 36. Consequently, the flow of crankcase emissions and air through the device 10 is decreased. This decreased flow mode of operation corresponds to idle or low speed engine operation.

As previously indicated, it is desirable under certain operating conditions of a vehicle engine to provide substantially increased flow of crankcase emission vapors and air through a PCV device. Accordingly, the housing 12 includes a portion 60 defining a bypass flow passageway 62 relative to the normal flow control passage 36. Passageways 36 and 62 are interiorly separated by a wall portion 64. The wall 64 has an opening 66 therethrough connecting the bypass passageway 62 directly with the outlet passage 24 downstream from the flow control passage 36. The bypass passage 64 is normally closed by a lower end portion 68 of a bypass control valve 70. The bypass control valve 70 is a spool type valve having a main body portion 72 and including the lower end portion 68. The body 72 of valve 70 has an upper end portion opposite the lower end portion 68 including a radially outwardly flared portion 74 and a axially extending portion 76. The upper portion of the valve body 72, including portion 74 and 76 are housed within a bell-shaped portion 78 of housing 12 which partially defines a chamber 80 which is communicated with atmosphere through a vent port 82. The upper portion of valve body 72 and, particularly, radially extending surface 74 supports the central portion 84 of a flexible elastomeric diaphragm 86. Specifically, the central portion 84 of diaphragm 86 is secured to the underside of portion 94 and about the main body portion 72 by a retainer member 88 including a central portion 90 thereof which encircles the valve body portion 72 and is retained by means of shoulder 92 thereof. The radially outwardly extending portion 94 of member 88 acts as a back-up surface for the central portion of the diaphragm 86, therefore, securing the diaphragm to the bottom surface of body portion 74.

The diaphragm 86 is supported by housing portion 78. Specifically, an outwardly extending portion of member 78 forms a shoulder surface 94 against which is secured an outer peripheral edge or bead portion 96 of the diaphragm 86. The outer peripheral edge portion 96 of the diaphragm 86 is securely held against the shoulder 94 of housing portion 78 by means of an end cap member 98. Specifically, a downwardly projecting circular bead portion 100 engages the peripheral edge portion 96 of the diaphragm 86. The cover member 98 is secured to the L-shaped portion 78 of housing 12 by means of a snap-fit connection formed between corresponding arcuate surfaces 102 and 104 on adjacent portions of members 78 and 98.

The diaphragm 86, the upper surface 106 of the L-body 72 and the interior bottom surface 108 of member 98 define therebetween a vacuum pressure chamber 110. The vacuum pressure chamber 110 is communicated through an integral vacuum outlet passage 112 to a vacuum outlet 114 formed in the end surface of a nipple-type fitting 116. Specifically, nipple fitting 116 is adapted to be insertably retained to a hose (not shown) which leads to a controlled vacuum source. By this means, vacuum pressure is transmitted to the chamber 110 to cause the diaphragm 86 and attached valve body 72 to move upward to the position shown in FIG. 1 which is a high vacuum position of the device. This position represents the configuration the valve 70 would take when a selectively applied vacuum signal is applied to the device 10 so that a substantially large flow of crankcase emissions and air would pass through the bypass passage 62 and bypass the normal flow control passage 36 irrespective of where the plug valve 38 was located within passage 36.

The bypass valve 70 and attached diaphragm 86 is normally moved downward from the position shown in FIG. 1 to the dotted line position of the lower end 68' to close the bypass passage 62 to bypass the normal flow control passage 36. A spring 118 applies the force on the valve body 70 and diaphragm 86 to normally maintain the bypass valve and, specifically, its lower portion 68 in the closed portion 68' shown in FIG. 1. The spring 118 is housed at its upper end within the vacuum passage 112 and is supported at its lower end in a cylindrical recess within the body 72 of valve 70.

The lower portion 68 of the valve body 72 is provided with a hollow interior formed by blind hole 120 to make the movable portions of the vacuum operated device lighter and, thus, more responsive to a selectively controlled vacuum pressure. Also, the cylindrical outer surface of the lower portion 68 is provided with a series of circular grooves 122. The cylindrical surface of portion 68 of valve 70 between the grooves 122 engages the cylindrical surface 124 which defines the upper end of the bypass passageway 62. The grooves 122 form a labyrinth forming a tortuous path for leakage of fluid between the bypass passageway 62 and the chamber 80.

Although only embodiment of the subject selectively controlled PCV device has been illustrated and described in great detail, modifications obviously may be made to the device without falling outside the scope of the following claims which describe the invention.

We claim:

1. A positive crankcase ventilation control device for use with an internal combustion engine and, specifically, for controlling the flow of emission laden vaporous fluids from the crankcase thereof, the control device including selective power means for substantially increasing the flow of emission laden air through the device, comprising:

a generally hollow housing with an inlet forming portion adapted to be fluidly connected to the interior spaces of an internal combustion engine to receive emission laden air therefrom;

the housing having an outlet forming device adapted to be fluidly connected to the air and fuel inletting portion of the internal combustion engine for disposing of the emission laden air from the engine, the inlet and outlet portions being connected within the interior of the housing by a flow control passage of specific flow area;

an elongated valve plug member within the housing and having an end portion with a conically tapered configuration adapted to move progressively into the aforesaid flow control passage thereby decreasing the flow area thereof and, consequently, the total flow through the device;

yieldable means urging the elongated valve member toward a position ensuring maximum flow through the flow control passage, but being yieldable to allow the valve member to move so that the conically tapered portion progressively extends further into the flow control passage to thereby decrease the flow area and, consequently, decrease total flow through the device in response to a negative pressure differential of the outlet with respect to the inlet;

a bypass passageway formed in the housing in parallel with the aforesaid flow control passage thereby allowing a relatively large increased flow of fluid from the inlet to the outlet when the bypass passageway is unrestricted;

a bypass valve normally positioned to block flow through the bypass passageway, but capable of movement to allow a substantially uninhibited flow therethrough;

selectively energized power means for moving the bypass valve from the blocking position to a position allowing substantially increased flow between the inlet and outlet of the device whenever such increased flow is desirable.

2. The device disclosed in claim 1 in which the selectively energized power means for moving the bypass valve includes a flexible diaphragm forming a movable wall of a vacuum pressure enclosure operably connected to the bypass valve member.

3. The flow control device of claim 1 of which the elongated valve member is arranged so that a second end portion and an aperture forming inlet member are engaged when the spring urges the elongated valve member toward a normal position, the aperture forming inlet member having channel means formed therein to permit a minimal flow of fluid from the inlet to the outlet about the second end of the elongated valve member.

4. The flow control device of claim 1 in which the bypass passageway is formed by a conical bore;

the bypass valve member is in the form of a cylindrical member movable axially along the conical bore, fluid leakage is prevented between the cylindrical valve member and the conical bore by means of a series of shallow circular grooves circumferentially extending about the cylindrical surface of the valve member.

5. The flow control device of claim 1 in which the bypass passageway is a cylindrical bore within the housing, the bypass valve has a first end portion of cylindrical configuration which is axially movable within the bypass passageway, the valve member having a second end portion with a blind aperture formed axially therein, a cover member extending about the second end portion of the bypass valve member and having a cylindrical recess having a vacuum flow aperture axially therein;

elongated yieldable spring means between the cover member and the bypass valve member and, specifically, with the blind hole of the bypass valve member supporting a lower end of the spring and the aforesaid cylindrical recess of the cover member supporting an upper end of the spring member whereby the spring normally biases the bypass valve member toward a position blocking the bypass passageway to prevent a substantial increase in fluid flow through the device.

6. A positive crankcase ventilation control device for an internal combustion engine to regulate the flow of emission laden air from the engine crankcase to the engine fuel and air inlet means and including a selectively energized bypass means for significantly increased flow through the device when desired, comprising:

a generally hollow housing defining a fluid inlet forming portion and a fluid outlet portion, the inlet and outlet portions being connected within the housing by a flow control passage of specific flow area;

an elongated valve member within the housing and having a conically tapered end portion axially aligned with the fluid flow control passage;

yieldable means in the housing and engaging the elongated valve member to urge the valve member toward a position whereas the conically tapered end portion is without the flow control passage, but being yieldable to allow the conically tapered end portion of the valve member to move axially into the flow control passage in response to a negative pressure differential between the device's outlet and inlet caused by manifold pressure of the associated engine, whereby flow through the device is progressively diminished by progressive movement of the conically tapered end portion of the valve into the flow control passage;

the housing defining a bypass passageway parallel to the aforesaid flow control passageway for delivering a significantly increased flow through the device irrespective of the position of the conically tapered end portion of the valve member in the flow control passage;

a bypass valve member axially movable in the bypass passageway between an open position allowing substantially increased flow rates through the device to a closed position substantially blocking flow through the bypass passageway;

a selectively energized power means for the bypass valve member to move the member between open and closed positions as desired.

7. For association with an internal combustion engine, a positive crankcase ventilation fluid control device normally regulating vapor flow from the crankcase to an engine inletting system by means of a spring biased valve plug located in the path of the vapor flow, the subject control device including a selectively activated bypass means to permit a substantial increase in fluid flow as desired, comprising:

a generally hollow housing defining an inlet forming portion admitting vapor flow and an outlet portion discharging vapor flow, the inlet and outlet portions being connected within the housing by a main vapor flow chamber and vapor flow control passage;

an elongated valve member located within the main vapor flow chamber and having a first end nearest the vapor inlet to interact therewith to limit the entry of vapor into the housing;

yieldable spring means in the main flow chamber normally urging the valve member toward the flow limiting position closest to the inlet portion, but permitting the valve member to move against the urging of the spring for increased vapor flow through the inlet portion;

the elongated valve member having a second end portion with a conical configuration axially movable with the valve member into the flow control passage to progressively decrease flow area between the flow control passage and the second end portion and the valve member thereby regulating the flow of fluid between the inlet and outlet portions of the device;

the housing defining a bypass passageway between the inlet and outlet portions of the device for delivering a substantially increased flow through the device irrespective of the position of the second end portion of the valve member within the flow control passageway when the bypass passageway is unrestricted;

a bypass valve member normally positioned in the bypass passageway to block any significant fluid flow through the bypass passageway, but capable of being positioned with respect to the bypass passageway to permit substantially increased and uninhibited fluid flow through the bypass passageway;

selectively energized power means to move the bypass valve between a position blocking flow through the bypass passageway and the position allowing substantially unrestricted flow through the bypass passageway.

* * * * *